United States Patent [19]

Gardner

[11] Patent Number: 4,971,032

[45] Date of Patent: Nov. 20, 1990

[54] FIREPLACE SHIELD

[75] Inventor: Maxwell Gardner, Wallingford, Conn.

[73] Assignee: Century Fireplace Furnishings, Inc., Wallingford, Conn.

[21] Appl. No.: 518,939

[22] Filed: May 4, 1990

[51] Int. Cl.[5] ..... F24B 1/192

[52] U.S. Cl. ..... 126/547; 126/548; 160/84.1

[58] Field of Search ..... 126/544–549, 126/500; 160/370.2, 84.1; 292/258, 242, 295

[56] References Cited

U.S. PATENT DOCUMENTS 4,027,649 6/1977 Jackson ..... 126/548
4,154,217 5/1979 Buckner ..... 126/544
4,236,499 12/1980 Simeone ..... 126/547
4,294,224 10/1981 Luther, Jr. ..... 126/548

FOREIGN PATENT DOCUMENTS 178541 4/1922 United Kingdom ..... 126/546
268083 3/1927 United Kingdom ..... 126/547

*Primary Examiner*—James C. Yeung
*Attorney, Agent, or Firm*—Bachman & LaPointe

[57] ABSTRACT

The present invention relates to a fireplace shield for closing off and sealing the opening of a fireplace during the time period when the active fire is dying out so as to prevent heat loss from a living area and down draft into a living area.

12 Claims, 2 Drawing Sheets

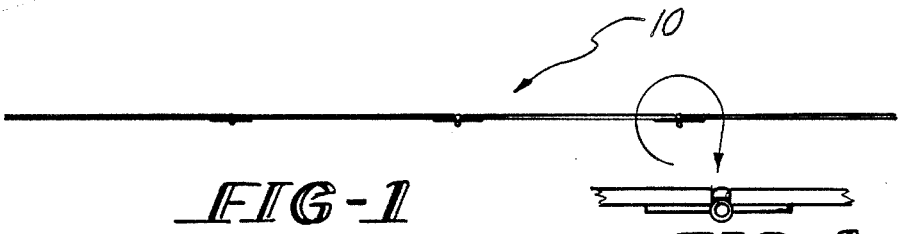
FIG-1
FIG-1A
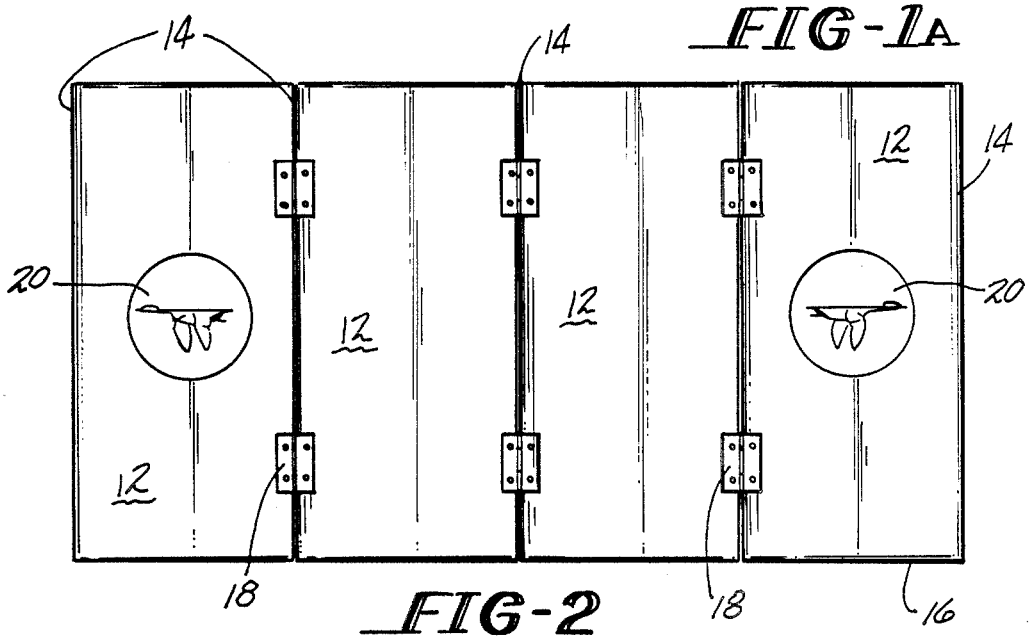
FIG-2
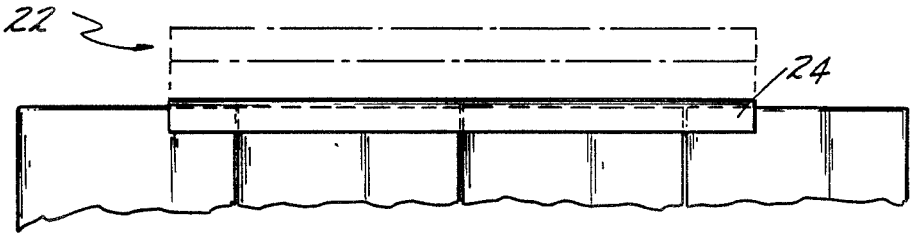
FIG-3
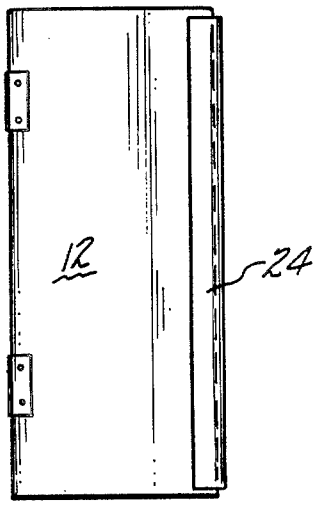
FIG-4
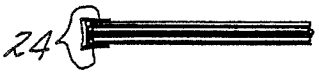
FIG-5

FIREPLACE SHIELD

BACKGROUND OF THE INVENTION

The present invention is drawn to a fireplace shield and, more particularly, a fireplace shield for closing off and sealing the opening of a fireplace.

It is well known, that during the operation of a fireplace, hot gases arising from a fire will draw large amounts of heated air out of a room and discharge the heated air up the chimney of the fireplace. Normally, during the active combustion of wood in a fireplace, the loss of heated air from the room is generally compensated by the heat conducted and radiated out of the fireplace by the burning wood. As a result of the foregoing, there tends not to be any great heat loss during the active combustion of the fire and, therefore, for esthetic reasons it is preferred to leave the fireplace open rather than provide glass doors for sealing the fireplace during active combustion.

After a fire has completely died out, it is common to close the damper on the fireplace chimney in order to prevent the loss of heat from the room up the chimney. However, it is not possible to close the damper on the fireplace chimney until the fire has completely died down. Thus, during the period between active combustion and the fire being completely extinguished, there is a time frame where the damper must remain open and substantial heat loss occurs from the room up the chimney. In addition to unwanted heat loss up the chimney, there is substantial danger of down draft which might result in forcing aches out of the fireplace and into the room.

Naturally, it would be highly desirable to provide an efficient and effective manner for sealing the opening of a fireplace during the time period before the fire is completely burned out and that point when the fireplace damper can be closed in order to prevent heat loss and/or unwanted down drafts.

Accordingly, it is a principal object of the present invention to provide a fireplace shield for closing off and sealing the opening of a fireplace.

It is a particular object of the present invention to provide a fireplace shield as set forth above which is effective in preventing heat loss from a room and unwanted down draft into a room during the period when an active fire is dying out.

It is a still further object of the present invention to provide a fireplace screen as aforesaid which may be readily usable in combination with any free standing fireplace screen.

It is a still further object of the present invention to provide a fireplace shield as set forth above which is easily transportable and readily storable.

Further objects and advantages of the present invention will appear hereinbelow.

SUMMARY OF THE INVENTION

The present invention relates to a fireplace shield for closing off and sealing the opening of a fireplace during the time period when the active fire is dying out so as to prevent heat loss from a living area and down draft into a living area.

In accordance with the present invention, the fireplace shield comprises a plurality of substantially rectangular panels which are pivotably mounted one to another along at least one lateral edge thereof in a manner which allows the panels to be freely pivoted between a first position wherein the panels are extended in a side by side relationship and a second position wherein the panels lie one on the other. In accordance with the particular feature of the present invention, the fireplace shield may be secured in either of the two aforesaid positions by means of a U-shaped locking bar which is adapted to be fitted over the edges of the fireplace shield so as to hold the panels either together in their second position or extended in their first position. The fireplace shield of the present invention in its unfolded or first position fits behind any free standing fireplace screen and is held by the free standing fireplace screen against the fireplace opening for sealing same. Once the fire has died out, the fireplace shield may be folded and secured by the locking bar in the folded position for storage or may be left in place until the fireplace is again used. If left in place, the fireplace shield may be made with decorative indicia in order to improve the esthetic quality thereof.

In accordance with the present invention, an effective and convenient device is provided for effectively sealing off a fireplace opening so as to prevent heat loss from and down draft to a living space when an active fire is dying out.

BRIEF DESCRIPTION OF THE DRAWINGS

FIG. 1 is a top view of a fireplace shield in accordance with a present invention;

FIG. 1*a* is an enlarged fragmented top view illustrating the pivotable joint between adjoining panels;

FIG. 2 is a front view of the fireplace shield showing decorative indicia on the individual panels of the fireplace shield;

FIG. 3 is a partially fragmented view illustrating the locking of the panels in their extended position;

FIG. 4 is a side view showing the locking of the panels in their folded position;

FIG. 5 is a top view showing the locking of the panels in their folded position;

DETAILED DESCRIPTION

Figure 6:
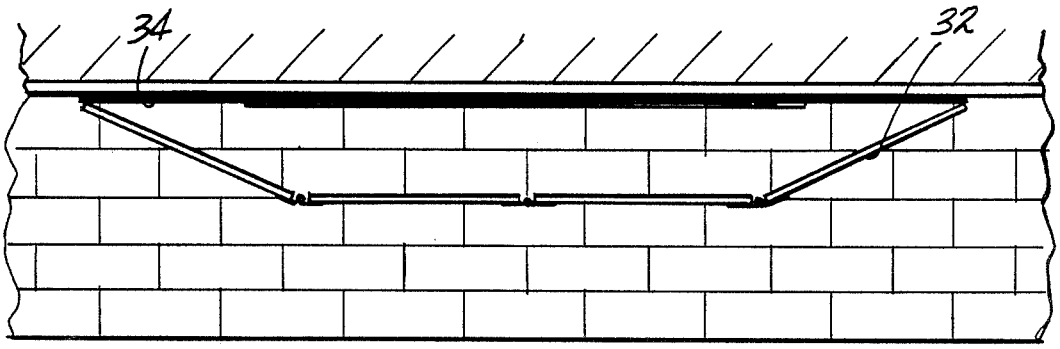
FIG. 6 is a top view of a fireplace opening showing the fireplace shield of the present invention held in position by a free standing fireplace screen.

The fireplace shield of the present invention will be described in detail with reference to FIGS. 1–7.

With reference to FIGS. 1 and 2, the fireplace shield of the present invention 10 comprises a plurality of panels 12 which are substantially rectangular in configuration. The number of panels employed and the size of the individual panels depends on the dimensions of the fireplace opening which is to be sealed. In general, most fireplace openings are between 36"W X 30"H and 48"W x 32"H. For the standard sized fireplace opening a four panel screen has been found to be ideal.

As noted above, the panels 12 are substantially rectangular in shape and comprise two long edges 14 and two short edges 16. The long edges 14 of the panels 12 are provided with a pivotable joint 18 for securing adjoining lateral edges of the panels 12. These pivotable joints may take any form known in the art and for the sake of illustration and description only are shown to be in FIG. 1*a* a hinge-type pivot joint. As a result of the pivotable joints 18 between adjacent panels 12, the panels 12 may be extended to a first position as shown in FIGS. 1, 2 and 3 for sealing the fireplace opening or folded to a second position as illustrated in FIGS. 4 and 5 wherein the panels lie one on top of the other for storage purposes. The panels 12 may include decorative indicia 20 if desired. Seals formed of a refractory material may be provided on the lateral edges of the panels for sealing any gaps therebetween if desired.

In accordance with the particular feature of the present invention, the fireplace shield is held in either its first position, that is, in its extended position as shown in FIG. 2 or its second position, that is, its storage position or folded position as shown in FIG. 4, by means of a locking bar 22. In the preferred embodiment of the present invention, the locking bar comprises an elongated U-shaped channel which is of sufficient length to engage all four of the panels when in their extended or first position as illustrated in FIG. 3. The U-shaped locking bar 22 is formed of a material which is flexible in nature, such as spring steel or the like, so that the legs 24 of the U-shaped locking bar 22 can clamp the four panels when in their first extended position and may be readily resiliently expanded to lock the four panels together when the panels are in their folded position as illustrated in FIGS. 4 and 5. Thus, the locking bar 22 is capable of firmly holding the fireplace shield in either its operative position wherein the panels are extended in a side by side relationship or in its storage position wherein the panels lie one on the other.

Figure 7:
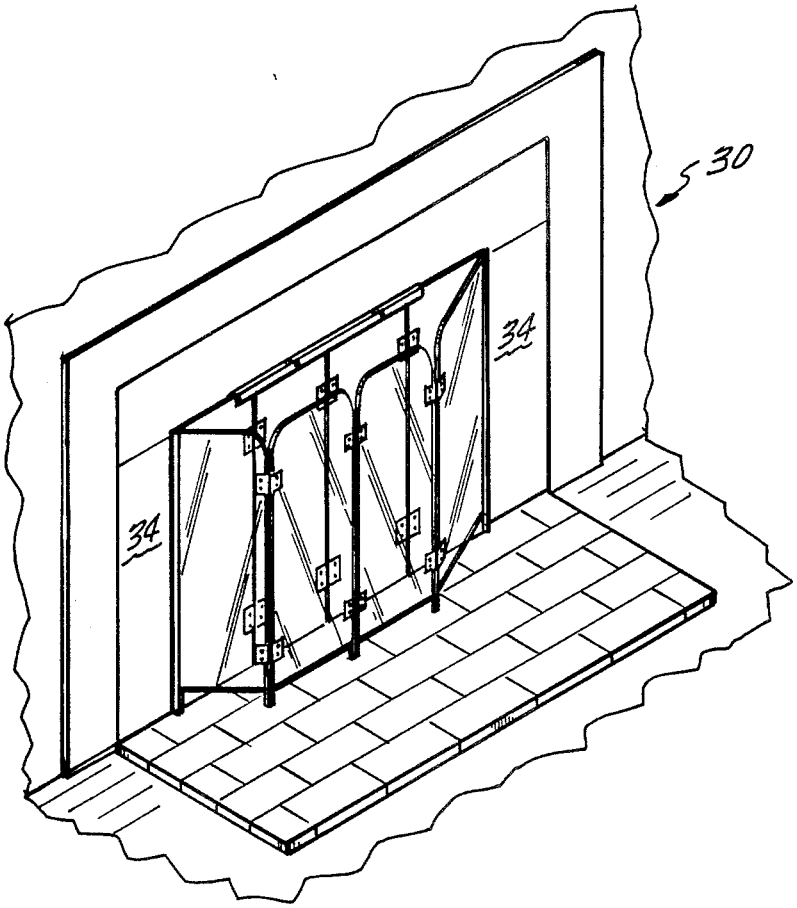
FIG. 7 is a perspective view showing the fireplace shield of the present invention in an active position.

With reference to FIGS. 6 and 7, when the fireplace shield 10 is secured by locking bar 22 in its operative position against the face 34 of the fireplace as shown in FIG. 3, the fireplace shield is held in place for sealing the opening of a fireplace 30 by a free standing fireplace screen 32 which is customarily used with a fireplace when actively combusting wood or the like therein. Accordingly, the fireplace shield of the present invention is readily usable with any existing fireplace which employs a free standing fireplace screen. In addition, the fireplace shield of the present invention effectively seals a fireplace opening against heat loss and unwanted down draft to and from a room. After use of the fireplace shield, the fireplace shield is readily foldable and transportable for storage until further use. In the alternative, the fireplace shield may remain in place until the fireplace is to again be used.

The fireplace shield of the present invention combines beauty and function in a manner which allows for easy use thereof in an efficient manner and is adaptable for use with virtually all existing fireplaces which employ free standing fireplace screens.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A fireplace shield for closing off the opening of a fireplace comprising at least two substantially rectangular panels having first and second pairs of opposed lateral edges, pivot means secured to at least one of said lateral edges of each of said plurality of panels for securing at least two of said plurality of panels to each other in a pivotable manner for allowing said at least two panels to be freely pivoted between a first position wherein said at least two panels lie one on the other and a second position wherein said at least two panels lie side by side in an extended relationship, and locking means removably fastened to at least one of said lateral edges of each of said at least two panels for securing said at least two panels in said first position and said second position wherein said panels when secured in said second position cover the opening of said fireplace.

2. A fireplace shield according to claim 1 wherein said at least one lateral edge of each of said plurality of panels provided with said pivot means further includes sealing means for sealing the edge of each panel when in said second position.

3. A fireplace shield according to claim 2 wherein said sealing means is formed of a strip of ceramic material.

4. A fireplace shield according to claim 2 wherein said first pair of opposed lateral edges is longer than said second pair of opposed lateral edges.

5. A fireplace shield according to claim 4 wherein said pivot means is secured to a lateral edge of said first pair of opposed lateral edges.

6. A fireplace shield according to claim 1 wherein said locking means comprises an elongated U-shaped element for clamping over the lateral edges of said panels.

7. A fireplace shield according to claim 1 wherein said locking means is fastened to one edge of said first pair of opposed edges when securing said panels in said first position and is fastened to one edge of said second pair of opposed edges when securing said panels in said second position.

8. A fireplace shield according to claim 1 wherein said fireplace shield comprises four substantially rectangular panels.

9. A fireplace shield according to claim 1 wherein said first pair of opposed lateral edges is longer than said second pair of opposed lateral edges.

10. A fireplace shield according to claim 9 wherein said pivot means is secured to a lateral edge of said first pair of opposed lateral edges.

11. A fireplace shield according to claim 10 wherein said locking means is secured to the other lateral edge of said first pair of opposed edges when said panels are in said first position.

12. A fireplace shield according to claim 10 wherein said locking means is secured to a lateral edge of said second pair of opposed lateral edges when said panels are in said second position.

* * * * *